United States Patent [19]

de la Vega

[11] 4,295,643

[45] Oct. 20, 1981

[54] APPARATUS AND METHOD FOR HANDLING JACKETS OF PRINTED MATTER

[76] Inventor: Alejandro J. de la Vega, 629 Ote. Washington St., Monterrey, Nuevo Leon, Mexico

[21] Appl. No.: 155,591

[22] Filed: Jun. 2, 1980

Related U.S. Application Data

[63] Continuation of Ser. No. 48,064, Jun. 13, 1979, abandoned, which is a continuation of Ser. No. 897,022, Apr. 17, 1978, abandoned.

[51] Int. Cl.[3] ..... B65H 5/30

[52] U.S. Cl. ..... 270/57; 474/901

[58] Field of Search ..... 270/57, 55, 21, 6; 198/422, 32; 93/93 R, 93 M

[56] References Cited

U.S. PATENT DOCUMENTS

| | | | |
|---|---|---|---|
| 1,856,978 | 5/1932 | Terrey | 93/93 R |
| 2,698,174 | 12/1954 | Deuel et al. | 270/55 |
| 2,873,113 | 2/1959 | McWhorter | 270/55 |
| 3,052,463 | 9/1962 | Snyder | 270/57 |
| 3,269,720 | 8/1966 | Schluckebier et al. | 270/57 |
| 3,522,942 | 8/1970 | Hepp | 270/55 |
| 3,593,624 | 7/1971 | Dufour | 198/422 |
| 3,693,486 | 9/1972 | Maniaci | 198/32 |
| 3,702,186 | 11/1972 | Duchinsky | 270/6 |
| 3,711,084 | 1/1973 | Hart et al. | 270/57 |
| 3,762,697 | 10/1973 | Bolza-Schunemann | 270/6 |
| 3,784,187 | 1/1974 | Takayanagi | 270/6 X |
| 3,877,692 | 4/1975 | Kluge et al. | 270/55 |
| 3,953,018 | 4/1976 | Maopolski | 270/55 |
| 3,999,454 | 12/1976 | Tiso et al. | 270/21 |
| 4,034,974 | 7/1977 | Maopolski | 270/55 |
| 4,079,928 | 3/1978 | Weshenfelder | 270/55 |

*Primary Examiner*—E. H. Eickholt

*Attorney, Agent, or Firm*—Arnold, White & Durkee

[57] ABSTRACT

An inserting machine is provided with mechanisms which allow it to operate in conjunction with a rotary printing press. In a preferred embodiment, the inserting machine is driven synchronously by the press and is fed newspaper jackets directly from the printing press without the need for intervening jacket feeders or stackers. A diverting mechanism which oscillates is positioned previous to the shingling operation of the press folder to divide the single press stream into multiple streams by diverting alternate jackets to different conveyors which are driven at a slower throughput. The divided streams of jackets are transported via the conveyors to an inserting machine which has two inserting lines arranged in a tandem configuration in order to insert at double the speed of a single line inserter and also in order to compensate the folds in the stacks and to output a bundle rather than a stream.

16 Claims, 8 Drawing Figures

JACKET DELIVERY FROM PRESS

JACKET DELIVERY FROM PRESS
INSERTING LINE No. 1
INSERTING LINE No. 2
INSERT FEEDER HEAD
INSERT FEEDER HEAD
TO COMPEN-SATING STATION
20
32
56
70
80
82
106
108
110
112
113
120
122

APPARATUS AND METHOD FOR HANDLING JACKETS OF PRINTED MATTER

This is a continuation of application Ser. No. 048,064, filed June 13, 1979, now abandoned, which is a continuation of Ser. No. 897,022, filed Apr. 17, 1978, now abandoned.

BACKGROUND OF THE INVENTION

1. Field of the Invention

The invention relates to apparatus and methods for feeding jackets of printed matter into inserting machines and the related feeding of inserts into the jackets to form finished products which are compensated and stacked to form bundles. In an illustrated embodiment, the invention relates to the feeding of inserts into newspaper jackets produced on a rotary printing press.

2. Description of the Prior Art

In the assembly of printed matter for distribution, it is often desirable to insert one type of printed matter within another to form the finished product. In particular, it is desirable to have an efficient means for feeding inserts into jackets, for example, feeding advertisements or so-called Sunday supplements, into a newspaper jacket.

As is well-known in the art, the printed web on a rotary printing press moves to a folding cylinder where it is cut, folded and then deposited by a flyer drum on a conveyor belt. The conveyor belt carries the complete product in a single stream of overlapped or shingled jackets. According to present practice, this stream is conveyed away from the press and then stacked into bundles either by hand or by a machine known as a stacker.

In instances where an insert is not desired, the stack or bundle is simply delivered to the loading dock. However, where it is desired to feed inserts into the newspapers jackets, the jackets must be taken out of the bundled state and "individualized" at a jacket feeding station on an inserting machine.

There are two distinct methods of operating inserting machines. In a first method, known as the "off-line" method, the stream of jackets coming off the press is transformed by hand or machine into a stack in one work area. The bundles are then transferred, usually by hand, to a second area where they are placed on a part of the inserting machine known as the jacket feeding station. This jacket feeding station individualizes jackets so that they may be opened, inserted, closed and delivered by the inserting machine which, according to prior art practices, produces a continuous shingled stream of inserted newspapers which must be again stacked and then compensated before being sent to the loading dock.

In this off-line method, the printing and inserting operations are not coordinated; furthermore, two stacking operations are required, a great deal of labor is used to manually transfer bundles from one work area to a second one and the inserting machine must be equipped with a jacket feeding mechanism whose sole purpose is to "unstack" or "individualize" the bottom jacket in the stack.

Despite its many disadvantages, the off-line system is the only system within the price range of many small and medium size newspapers.

The past decade has seen the advent of "on-line" systems wherein the printing operation is partially coordinated with the inserting operation. In the on-line system, the jackets are conveyed from the printing press to the inserter in the shingled manner and then formed into stacks at the jacket feeding station. The jacket feeding station takes the bottom jacket from the stack and "individualizes" this jacket so that it may be fed into the inserting machine where it is opened to receive an insert. Although the jackets from the press are conveyed directly to the inserting machine jacket feeder without previously unloading it from the conveyor as in the off-line technique, the printing and inserting operations are not synchronized on a one-for-one basis. Because of this lack of synchronization, the typical on-line system requires a number of mechanisms to correct for underspeed or overspeed conditions of press vs. inserter and overflow gates which receive the jackets when there is a shutdown or when the inserter cannot keep up with the press. Furthermore, the on-line inserters require complex detecting devices to activate or deactivate the jacket supply conveyors during conditions when there are either too many or not enough jackets available at the jacket feeder.

Thus, there is an acute need for a relatively simple and reliable apparatus and method for on-line feeding of jackets into inserting machines.

SUMMARY OF THE INVENTION

According to the present invention an inserting machine is provided with mechanisms which allow it to operate in conjunction with a rotary printing press. In a preferred embodiment, the operation of the inserting machine is fully synchronized with the operation of the press and is performed at the same speed.

The apparatus includes a diverting mechanism which oscillates and is located previous to the shingling operation of the folder of the printing press. The diverting mechanism serves to divide the single press stream into multiple streams by deflecting alternate newspaper jackets as they travel through the folder to different conveyors which are driven at a slower throughput in order to be compatible with the speed of the inserting line to which each conveyor is connected.

Every other jacket is directed to one path while alternate jackets are diverted at least to another one. Conveyor mechanisms comprising endless belts are adapted for holding the stream of newspapers therebetween.

At some point prior to entering the inserting machine, the conveyors are driven at such speed so as to cause the jackets to be positioned in a spaced-apart or non-shingled manner which is compatible with the operation of the inserting machine.

Since the multiple conveyors operate at the same speed as and are hooked directly to the inserting machine, the need for a jacket stacking and feeding operation is eliminated.

The multiple conveyors terminate at an inserting machine which has a novel configuration of tandem, parallel inserting lines. At the tandem inserting machine the newspapers in each conveyor form two lines of spaced-apart newspapers. The tandem inserting machine includes an insert feeding station on each line where the single newspapers in each line receive inserts from insert feeder heads.

After the insert feeding operation the two lines of newspapers are merged to form compensated stacks. Each compensated stack comprises two finished products with the fold line of one aligned opposite the fold line of the other. The stacks are then conveyed to a double bin stacking apparatus where they accumulate to form a compensated bundle of a predetermined number. The bundles are transferred to a roller top conveyor for delivery to a tying station and the loading dock.

Thus the dual or tandem inserting lines in the inserting machine permit:

(a) double the speed of a single line inserting machine;
(b) compensated fold in stacks; and
(c) bundles rather than streams.

One feature of the invention is the provision of means for forming plural paths emerging from the press with each path comprising a conveyor that is directly associated with an inserting line.

One aspect of this feature is that the jackets so conveyed have their shingling reduced by at least 100% when transforming the single path into multiple paths.

Another feature of the invention is the provision of a tandem inserting machine having means for transporting two lines of spaced-apart newspapers to a pair of insert feeder heads and means for merging and compensating the finished products into stacks of two compensated products which join in stacking bins to form bundles.

Yet another feature of the invention is the provision of means for directly driving the deflector mechanism and inserting machine by electrical and or mechanical connection to the printing press. One aspect of this feature is that the printing operation and the insert feeding operation are fully synchronized, i.e., for every newspaper exiting the press a newspaper is being fed an insert. Dry conditions and overflow conditions at the insert feeder stations are avoided.

DESCRIPTION OF THE PREFERRED EMBODIMENT

Figure 1:
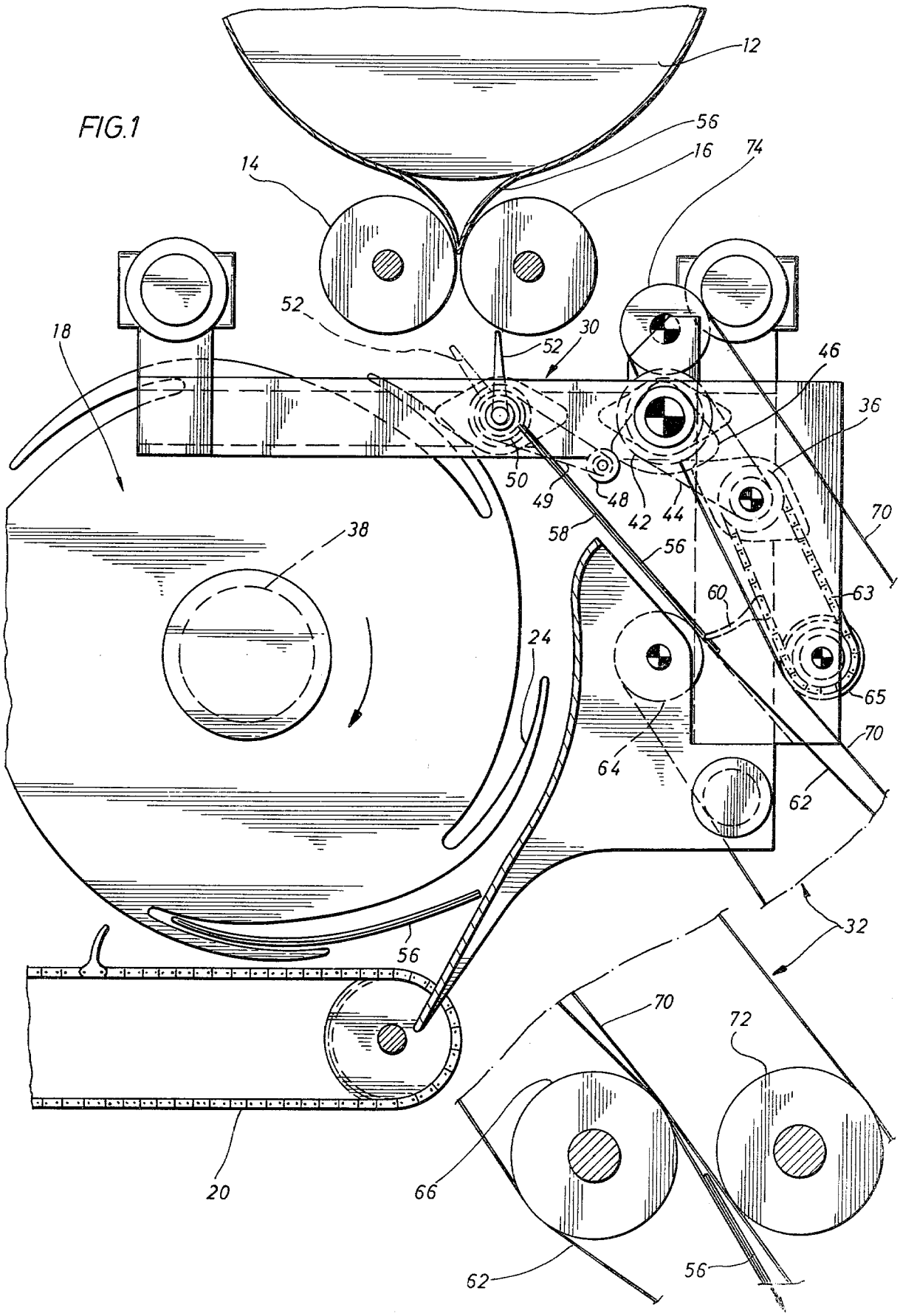
FIG. 1 is a side view of the deflector mechanism and jacket conveyors of the present invention shown in operative association with the folding cylinder, fold rollers and flyer drum of a conventional tucking blade folder of a rotary printing press.

Referring to the drawings, and in particular to FIG. 1, there is illustrated a portion of a conventional tucking blade folder of a rotary printing press to which a deflector mechanism 30 and auxiliary conveyor 32 have been added in accordance with the present invention. The printing press includes a folding cylinder 12, a pair of last fold rollers 14, 16, a rotating flyer drum 18 and a conveyor mechanism 20. In operation, the conventional printing press forms newspaper jackets at the folding cylinder as indicated by newspaper jacket 56 in FIG. 1. This jacket is conveyed between last fold rollers 14, 16 and into a pocket 24 of flyer drum 18 which rotates in a clockwise direction as shown in FIG. 1. Each jacket is deposited from the pocket onto conveyor 20. According to prior art practices, conveyor 20 moves at such a speed that the jackets are deposited thereon in an overlapped or shingled manner. Operation of conveyor 20 at a speed high enough to prevent overlapping jackets is impractical at typical press outputs because the jackets will fly off the conveyor.

In accordance with the preferred embodiment of the present invention, alternate newspapers emerging from last fold rollers 14, 16 are diverted from the flyer drum 18 by means of a deflector mechanism 30 and are conveyed to an auxiliary conveyor assembly 32. Deflector 30 is mechanically linked to the printing press so that it will automatically actuate at such times as to divert alternate newspaper jackets from receiving pocket 24. The jackets so diverted are directed to the auxiliary conveyor assembly 32.

A first sprocket shaft 36 is mechanically linked to the axis 38 of flyer drum 18 to establish the direct press-drive of the deflector mechanism 30 and auxiliary conveyor assembly 32. Although not illustrated, this mechanical connection may take the form of a chain-link or timing belt or other suitable mechanical linkage. The connection may also be electrical.

First sprocket or pulley shaft 36 is connected to a second sprocket or pulley shaft 42 by means of a rubber timing belt or chain link 44. Shaft 42 includes a cam 46 which actuates the deflector mechanism 30. As shown in FIG. 1, cam 46 is positioned to engage an associated cam follower 48 which is secured to arm 49 which is, in turn, mounted on a shaft 50. Arm 49 forms a substantially L-shaped assembly in conjunction with a first deflector blade 52. (Although only one blade 52 is illustrated in FIG. 1, shaft 52 mounts a plurality of identical blades 52 along its length). Thus, in operation, the rotation of cam 46 results in a back and forth motion of cam follower 48 which, in turn, causes deflector blades 52 to move into and out of the path of newspaper jackets exiting the last fold rollers 14, 16. First deflector blade 52 is shown in solid lines on FIG. 1 in a non-interrupt position and in dashed lines in a diverting position.

The size of the various sprockets or pulleys and the mechanical linkage to flyer drum axis 38 are chosen to cause the deflector blades 52 to move into the path of every other jacket exiting last fold roller 14, 16. The size of sprockets found on shafts 36, 42 and 50 have not been set forth and are believed to be well within the design capabilities of one skilled in the art.

As shown in FIG. 1, each alternate diverted newspapers, for example newspaper jacket 56, falls by gravity onto a slide plate 58. Before reaching the end of slide plate 58, the leading folded edge of jacket 56 is engaged by a timing spacer 60 which serves to break the downward movement of the jacket 56 and provide uniform spacing between the jackets entering auxiliary conveyor assembly 32. Timing spacer 60 moves downwardly after engaging the leading edge of jacket 56 and deposits the jacket onto a plurality of belts 62 which connect driven roller 64 and drive roller 66. (Although not illustrated in FIG. 1, there are a plurality of parallel spaced belts 62 engaging rollers 64 and 66). Spacer 60 is mounted on a toothed timing belt 63 or chain link which is driven by shaft 36 and engages idler roller 65.

After moving along conveyor 32, jacket 56 is also engaged on its upper surface by a plurality of parallel belts 70 (only one shown) which engage rollers 72, 74 and are intermediately engaged by roller 65. Thus, jacket 56 is held by pressure between multiple parallel belts 62, 70 for conveyance in a predetermined spaced relationship to a desired location. As shown in the broken away portion of FIG. 1, belts 62 and 70 do not stop at rollers 66, 72 but continue, thereby forming an endless conveyor for transporting the jackets 56 which are held by pressure therebetween.

In some applications of the invention the operator may wish to add inserts to only a portion of the total run of newspapers, for example, where regional advertising supplements are inserted into only a portion of the total run. In this situation it may be desirable to deactivate the deflector mechanism 30 at some point in the run, thereby allowing the complete output thereafter to be conveyed directly to flyer drum 18 and conveyor 20. The jackets so conveyed may form a shingled line and be conveyed directly to means for compensating and stacking. In order to enable the operator to deactivate the deflector mechanism 30, a solenoid (not shown) is provided which, when actuated, locks the cam follower 48 in the non-interrupt position. The solenoid is preferably actuated by a manual switch. A microswitch (not shown) is placed in series with the manual switch and solenoid so that the solenoid will retract only when there is a gap at the press stream. To this end, the microswitch is positioned adjacent the periphery of folding cylinder 12 so that it will close when contacted by a cam lobe (not shown) only at times when there is no jacket in the area of deflector blades 52.

Figure 1A:
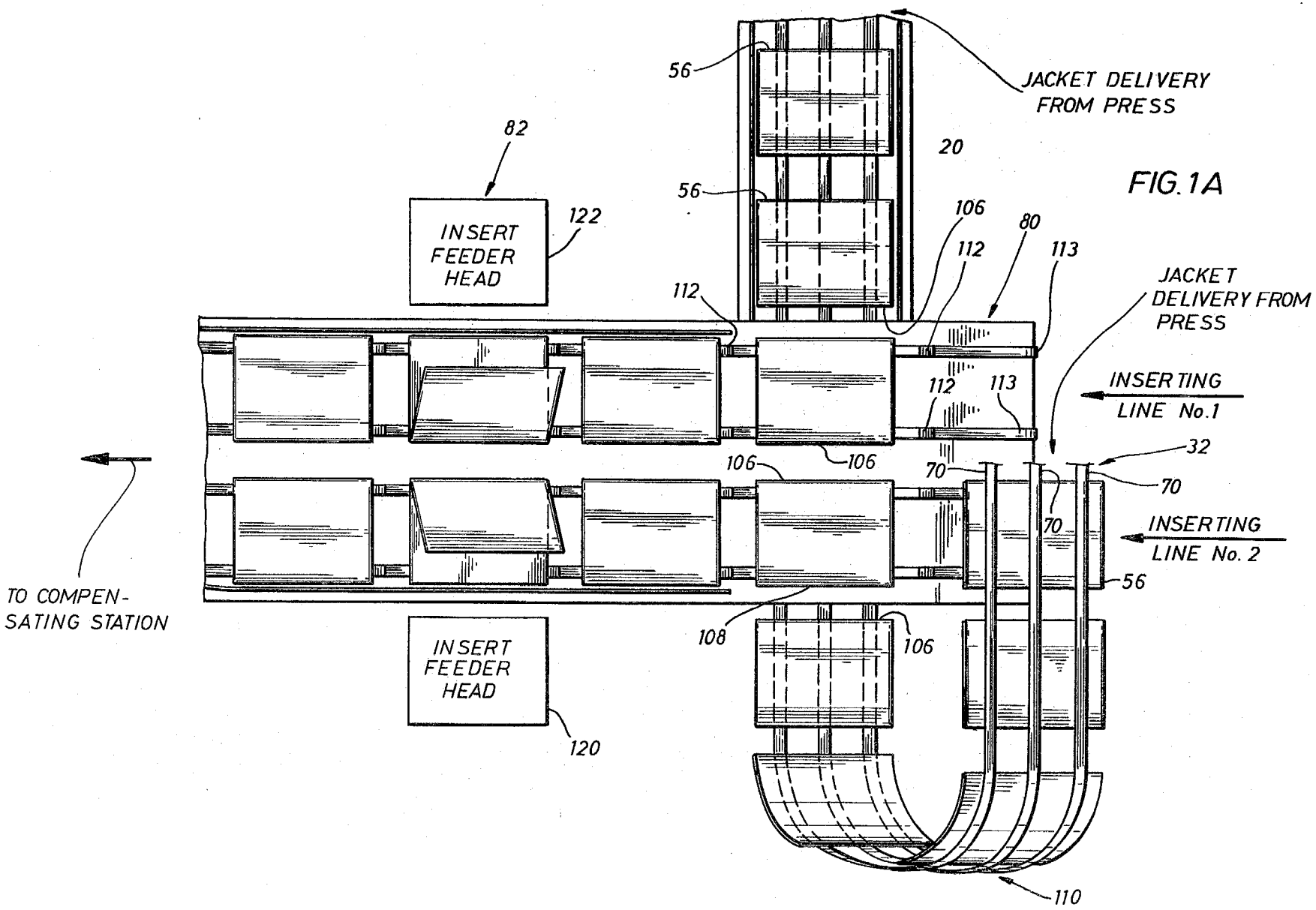
FIGS. 1A and 1B comprise a plan view of the tandem inserting machine which receives the jackets from the two conveyors illustrated in FIG. 1.
Figure 1B:
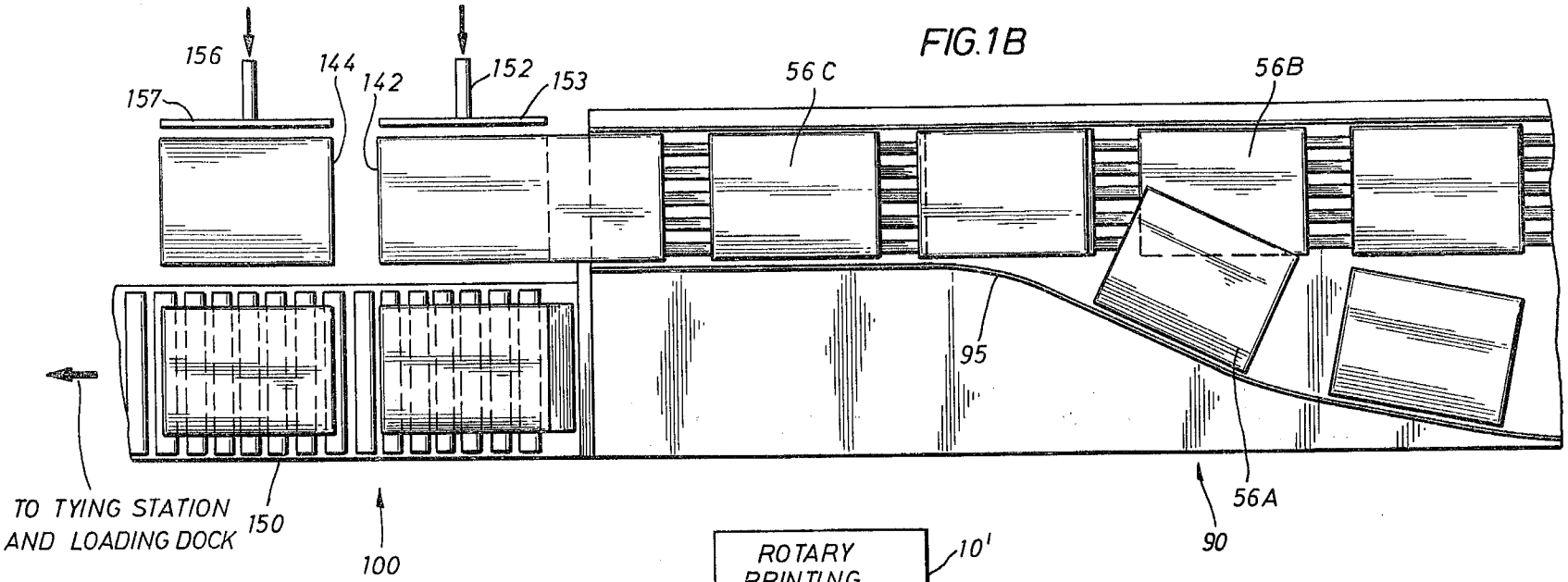

Referring now to FIGS. 1A and 1B, there is illustrated a tandem inserting machine 80 which is located remote from the printing press and which includes an insert feeding station 82, a compensating station 90 and a stacking station 100. Tandem inserting machine 80 receives spaced newspaper jackets 56 from conveyor 20 and auxiliary conveyor 32. As illustrated in FIG. 1A, the jackets 56 from conveyor 20 are deposited directly onto inserting line no. 1 with the jacket fold line 106 disposed toward the center of inserting machine 80. Jackets 56 conveyed between belts 62 and 70 of conveyor 32 are deposited on tandem inserting machine 80 on the opposite side from conveyor 20. In the illustrated embodiment, belts 62, 70 make a loop as indicated by reference numeral 110 so that the fold line 106 is disposed at the center of inserting machine 80 when the jacket is deposited thereon. Thus, inserting machine 80 receives newspaper jackets 56 from opposite sides with their fold lines 106 disposed toward the center of machine 80 and with their open sides 108 disposed outwardly for engagement with the insert feeders in the manner described below.

In the preferred embodiment, inserting machine 80 is driven by mechanical linkage (not shown) directly connected to printing press 10 so that the printing press, conveyors 20 and 32, deflect mechanism 30 and machine 80 may be synchronously operated by a common drive. As jackets 56 are deposited onto inserting machine 80, the side-open edge of the jackets are positively engaged by timing spacing members 112 which are uniformly spaced on drive chain 113. To this end, the jackets 56 are deposited at some predetermined distance, for example 2–3 inches, in front of the next successive timing spacing member 112 and the spacing member is allowed to catch up with the side-open edge of the jacket 56 in order to positively direct it along inserting machine 80.

A pair of insert feeder heads 120 and 122 are positioned immediately downstream from the point where jackets 56 are deposited on inserting machine 80. Before jacket 56 enters insert feeding station 82 the upper leaf of jacket 56 is opened by a conventional sword or pneumatic system (not shown) to allow an insert to be inserted into the jacket 56 so opened. It should be pointed out that the jackets are already "individualized" by virtue of their being conveyed at spaced intervals to inserting machine 80. Hence, the insert feeding line requires only the individualization of the inserts and not the individualization of the jackets. As pointed out above in the discussion of the prior art, conventional complete jacket feeder assemblies must individualize jackets from the bottom of a stack. In the preferred embodiment, the tandem inserting machine only requires insert feeder heads 120, 122 which may be model no. 227-E newspaper insert feeder heads manufactured by Muller-Martin Corporation of 40 Rabro Drive, Hauptauge, New York 11787. Other suitable insert feeding mechanisms may be utilized.

Inserting machine 80 conveys the jackets plus inserts (hereinafter referred to as the "finished product") to compensating station 90 where the tandem finished products are merged into one line to form a compensated stack of two finished products. As illustrated in FIG. 1B, the path of jacket 56A is diverted so that the fold line of this jacket passes above the fold line of jacket 56B thus forming a compensated stack of two finished products. The merging of jacket 56A above jacket 56B is accomplished by raising the conveyor of jacket 56A so that its fold line is slightly higher than the fold line of jacket 56B. Then a siderail or equivalent deflector bar 95 urges jacket 56A over jacket 56B to form a compensated stack 56C of two finished products.

Figure 2:
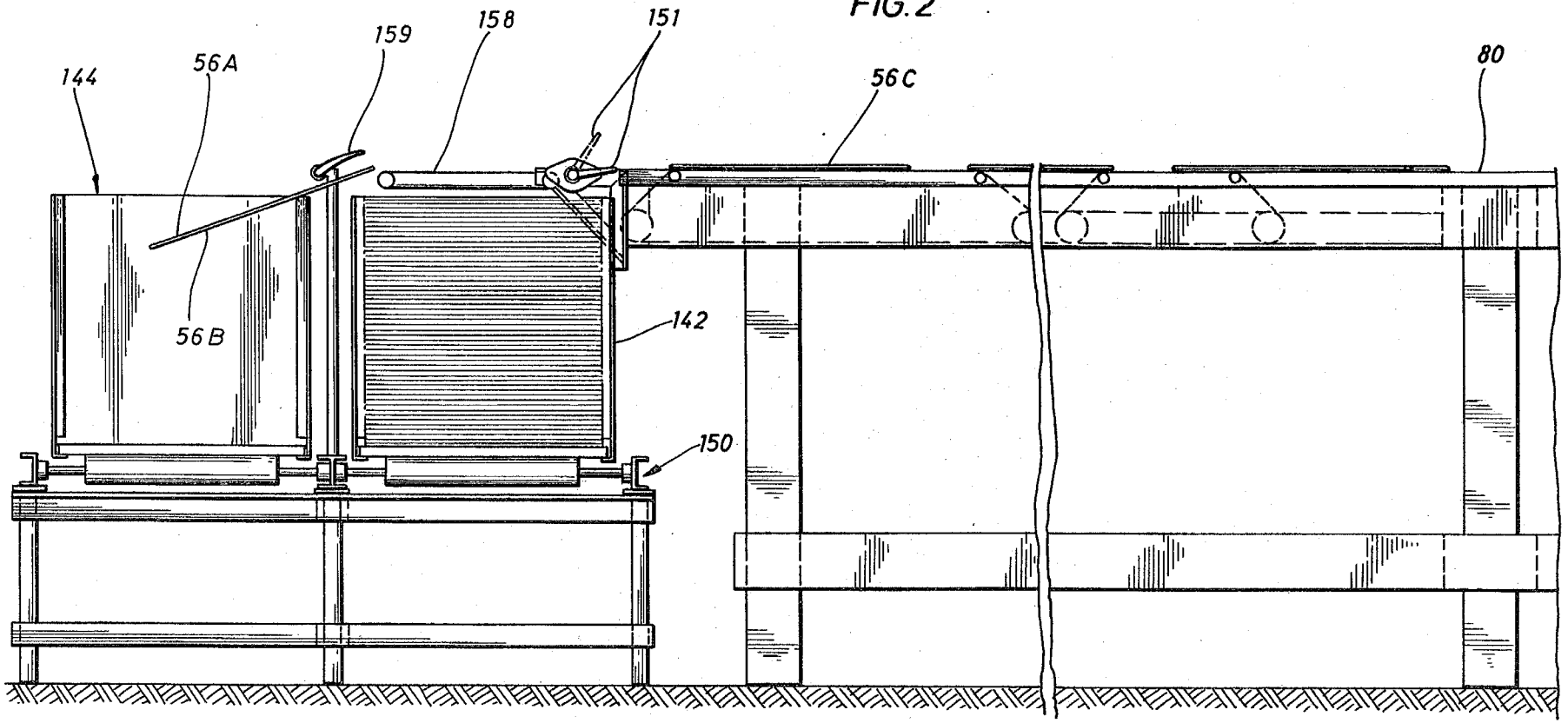
FIG. 2 is a view of the stacking bins taken substantially along line 2—2 of FIG. 3.
Figure 3:
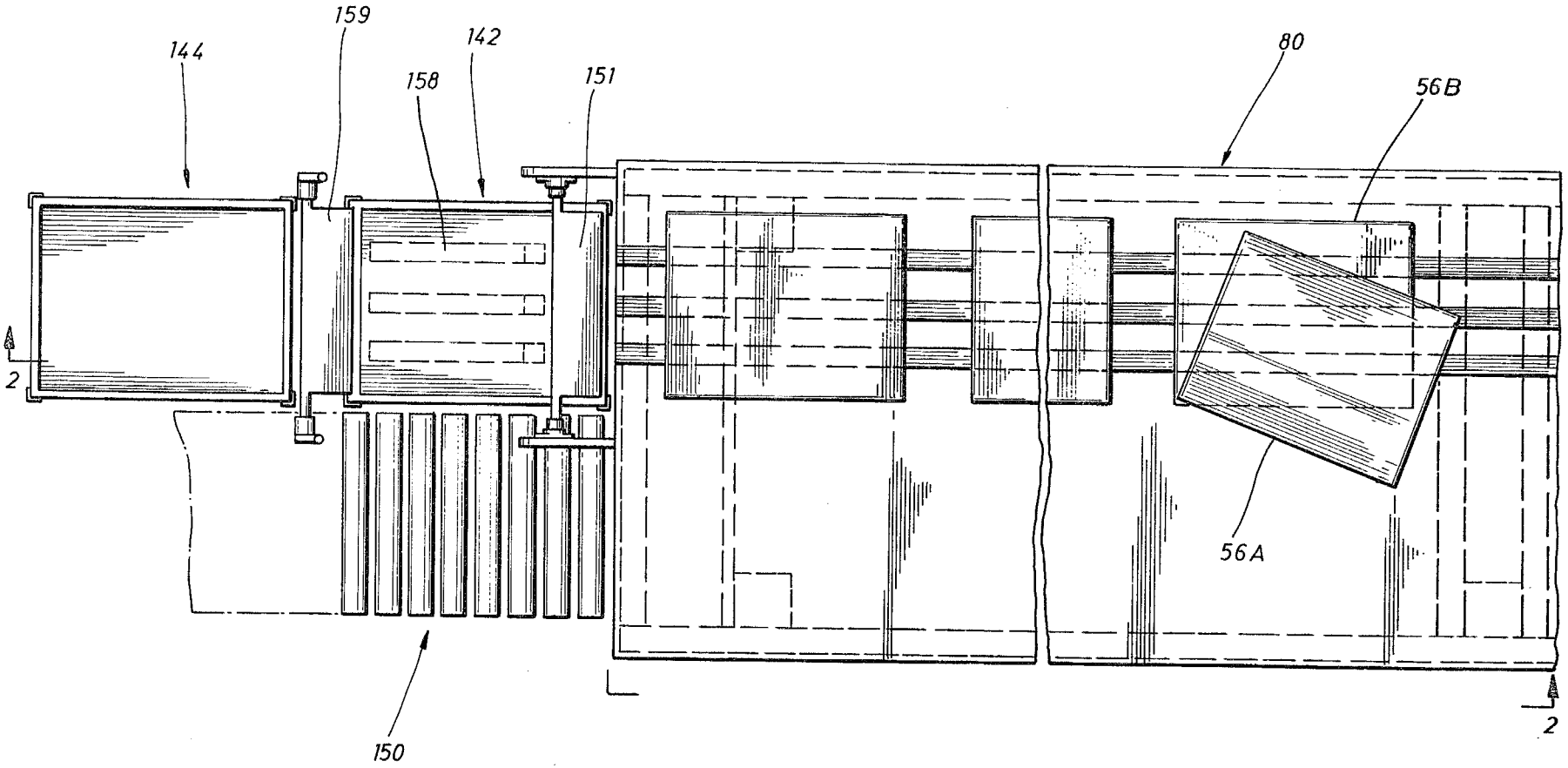
FIG. 3 is a plan view of a portion of the tandem inserter showing details of the stacking bins.

The series of compensated stacks of two finished products is conveyed from the compensating station 90 to stacking station 100. Referring to FIGS. 2 and 3, stacking station 100 is shown as including two on-line bins 142, 144. This on-line double stacking bin arrangement is adapted to receive the single line delivery of compensated stacks of two finished products and to deliver them to a rollertop conveyor 150 in compensated bundles of a predetermined number. In operation, the compensated stacks from inserting machine 80 are first deposited into bin 142. In order to direct the stacks into bin 142 a deflector bar 151 is raised to the position shown in dashed lines in FIG. 2. When a complete bundle has been formed in bin 142, deflector bar 151 is lowered to the position shown in solid lines so that the finished products may be conveyed by a short conveyor 158 to the second bin 144. Bar 159 assists in guiding the finished products into bin 144. While bin 144 is receiving a flow of newspapers from conveyor 80, the stack in bin 142 is moved by a push arm 152 and its associated push face 153 to the surface of rollertop conveyor 150 (See FIG. 1B). In this manner bins 142 and 144 alternate to handle the continuous flow of compensated stacks of finished products from conveyor 80. Push arm 156 and push face 157 served to move the stack in bin 144 onto rollertop conveyor 150 at the appropriate time.

The bundle-size stacks on rollertop conveyor 150 are conveyed downstream to a tying station and a loading dock (not shown).

OPERATION OF PREFERRED EMBODIMENT

In operation, the illustrated apparatus provides a fully synchronized system for receiving newspaper jackets from a conventional rotary printing press, conveying said jackets on multiple conveyors, preferably in a spaced-apart manner, depositing said jackets on the inserting lines of a tandem inserting machine, feeding inserts into opposed jackets on said tandem inserting machine, merging the finished products on said tandem inserting machine into individual stacks of two compensated finished products, stacking said compensated stacks of two at a dual-bin stacking station and conveying the bundlesize stacks on a roller top conveyor to the tying operation and loading dock.

In more detail, the operation is as follows: first the folded jackets are intercepted at the press folder before entering the shingling mechanism of said folder and are alternately diverted along multiple rather than single paths. That is, every other one of the jackets is received by the conventional press drum conveying mechanism 20 and the alternate jackets are received by an auxiliary conveying mechanism 32. The transport rates of both conveyors are the same and are preferably selected so that the jackets are conveyed away from the printing press in a nonoverlapping or non-shingled manner. The deflector mechanism utilized for diverting alternate newspapers is mechanically and/or electrically linked to the printing press to assure reliable synchronization. Likewise, the auxiliary conveyor is linked to the first conveyor or some component of the printing press to assure synchronization of the conveying mechanisms.

The jackets on both conveyors are transferred to a remote location where they are deposited on a tandem inserting machine in an opposed relationship with their fold lines facing. The double line of jackets are transported to insert feeding stations where insert feeder heads feed the appropriate inserts into the jackets. Next the finished products (each comprising a jacket plus a selected number of inserts) are merged to form compensated stacks (i.e. stacks with folds opposing) of two finished products each. The compensated stacks are conveyed in a single line to one bin of the double bin stacking station which, as explained above, serves to accumulate stacks into a bundle of a predetermined size. Each bundle is laterally displaced to a roller top conveyor for transport to a tying station and a loading dock.

ALTERNATIVE EMBODIMENTS

Figure 4:
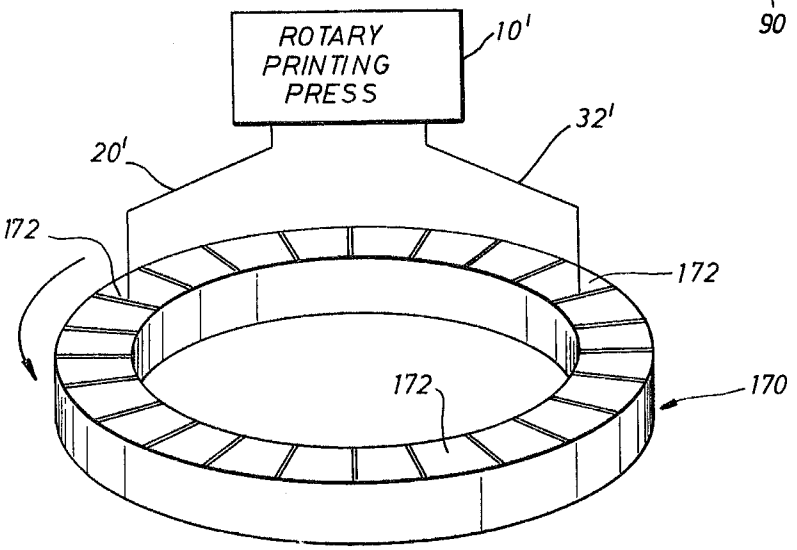
FIG. 4 is a schematic illustration of an alternative embodiment of the invention as used in association with a carousel-type inserting machine.

Referring to FIG. 4, there is illustrated a schematic representation of an alternative embodiment of the present invention. According to this embodiment, the multiple conveyors 20', 32' exiting the printing press 10' convey the spaced jackets directly to a carousel-type insert feeder 170, for example a carousel insert feeder as manufactured by Sheridan Corporation. In this embodiment, the carousel comprises a rotating mechanism having a plurality of vertical slots 172 adapted to receive newpaper jackets by gravity feed. The carousel speed is mechanically and/or electrically linked to the press speed and the speed of the multiple conveyors so that a jacket may be fed into each successive or alternate slots 172 of the carousel. The jackets are then fed inserts in the manner known in the art.

According to this alternative embodiment, alternate jackets are diverted at the press to provide multiple streams of spaced-apart jackets suitable for delivery to the carousel. Also it can be seen that synchronization between the conveyors and the carousel is critical.

Figure 5:
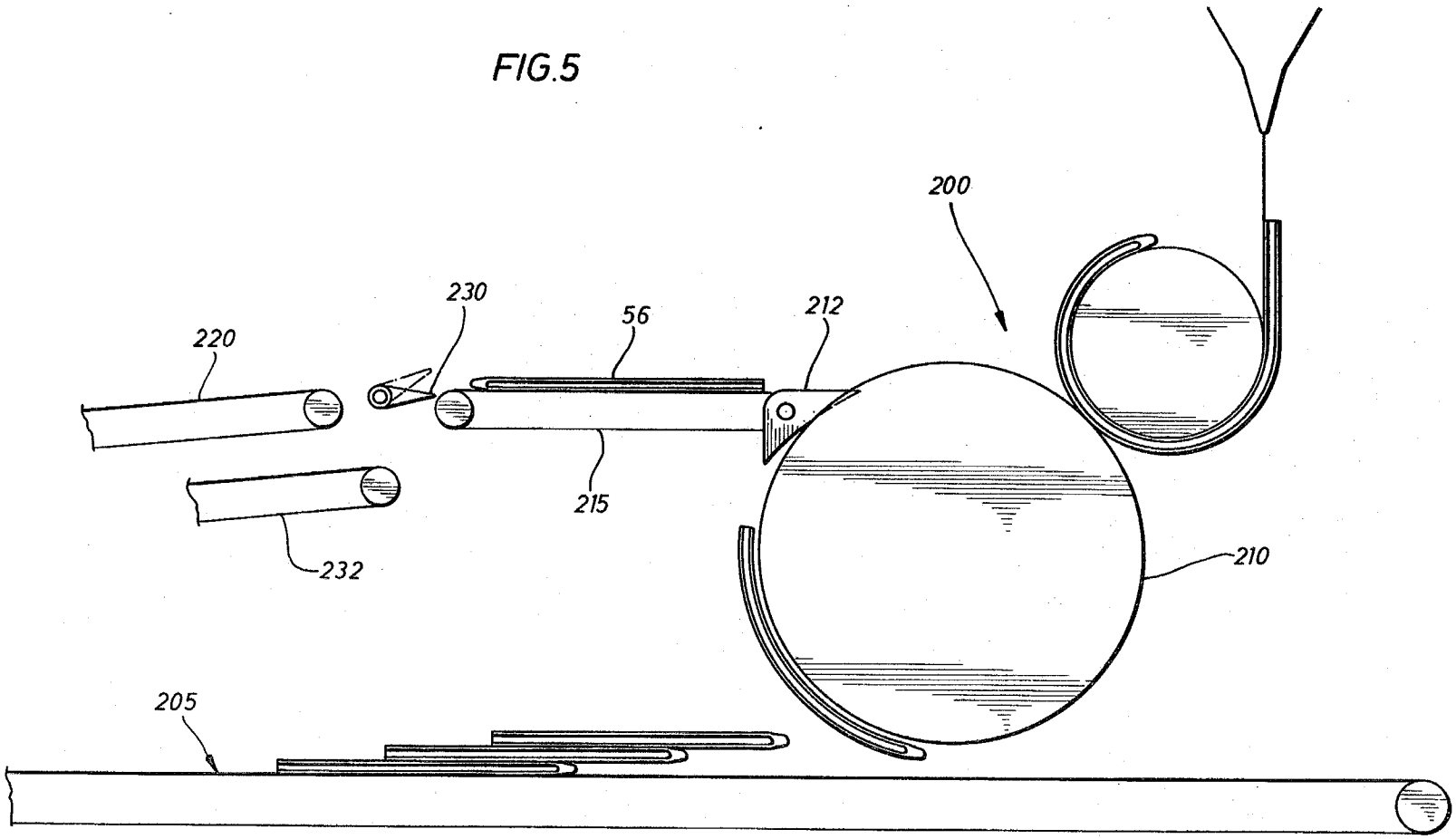
FIG. 5 is a side view of an alternate deflection mechanism as used in association with a typical jaw type folder of a rotary printing press.

FIG. 5 illustrates a second alternative embodiment which may be used in association with a typical jaw type folder 200 found on some rotary printing presses. According to prior art practices, folder 200 operates to fold the jackets and deposit the jackets in a shingled fashion on a typical conveyor mechanism 205. In accordance with the present invention, jackets 56 are deflected from their normal path by a fixed deflector 212 of the type utilized in quarter folding techniques which is located proximate drum 210. Deflector 212 serves to deflect jacket 56 to a short conveyor 215 also of the type used in quarter folding. At the end of conveyor 215 is located an oscillating diverter 230 which is mechanically and/or electrically linked to the press and diverts alternate jackets onto conveyors 220 and 232. Conveyors 220 and 232 transport the jackets to inserting line nos. 1 and 2 in the manner discussed above in connection with FIGS. 1, 1A and 1B.

Figure 6:
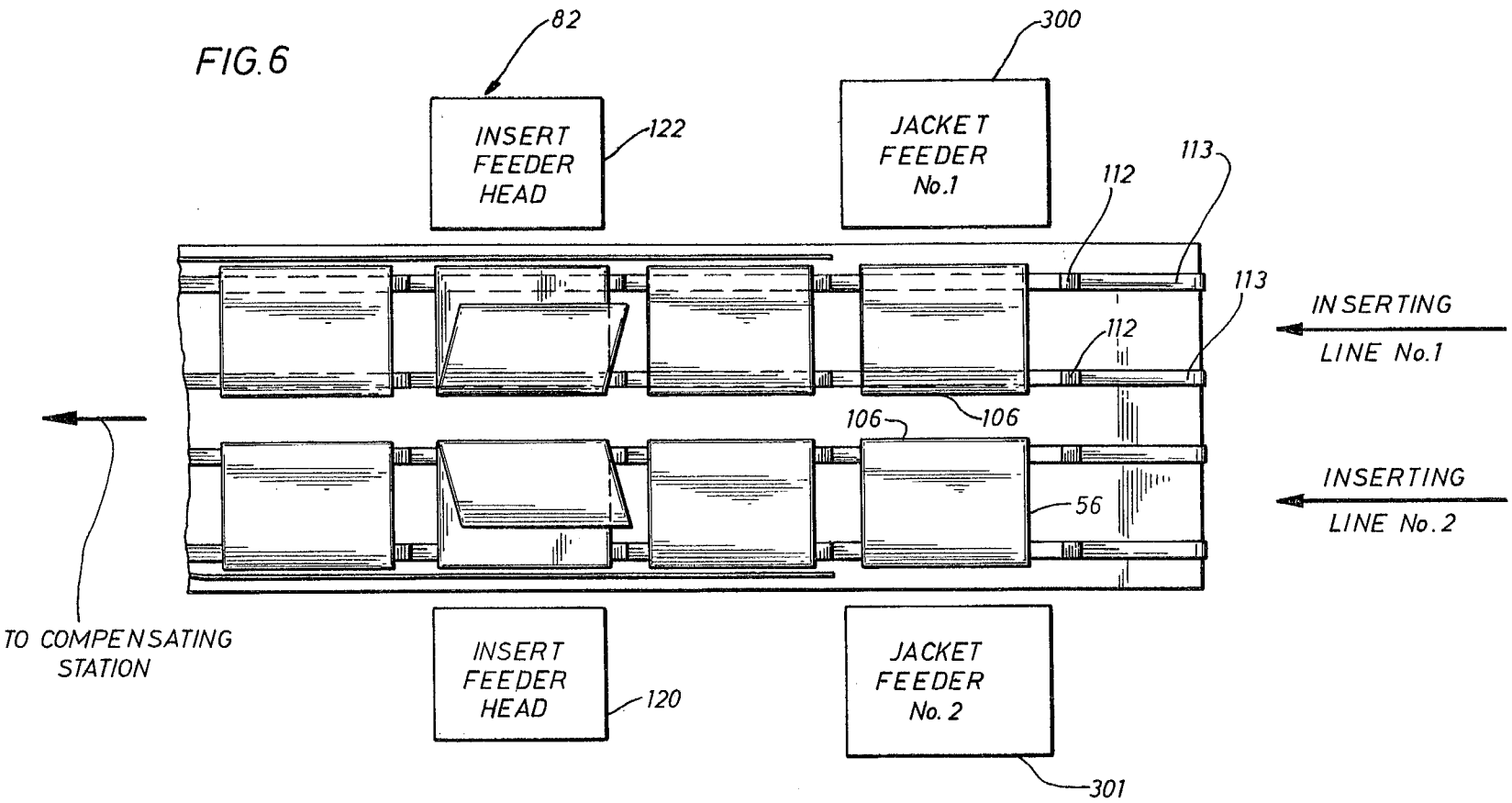
FIG. 6 is a view similar to FIG. 1A showing a portion of an alternative inserting machine adapted to receive jackets from a pair of jacket feeders.

FIG. 6 illustrates an alternative embodiment of the inserting machine wherein the jackets are fed to the inserting lines nos. 1 and 2 by means of a pair of jacket feeders 300, 301. This embodiment differs from that illustrated in FIG. 1A in that the jacket feed is not synchronously driven by the press. Rather, jackets are brought to the feeders 300, 301 in bundles and then individualized and fed to the inserting lines by means of feeders 300, 301. This alternative embodiment retains the advantages associated with the insert feeding, compensating and stacking functions performed at stations 82, 90 and 100 without requiring a direct, synchronous press drive.

Although the invention has been illustrated in conjunction with the feeding of inserts into newspaper jackets produced on a rotary printing press, the invention has application to the compilation of other types of printed matter. For example, magazines printed on a rotary press may be provided with inserts in accordance with the present invention. Also signatures of books may be conveyed from the press in the illustrated fashion in accordance with the present invention and then gathered to form a book in a manner analagous to insert feeding.

The present invention also has utility in the compilation of a very large amount of printed matter, for example the Sunday edition of a newspaper. In this application parallel rotary printing presses with a common drive may each run a portion of the pages (for example, ½ each) which will comprise the Sunday edition. The jackets from one press may exit the press in a plurality of spaced-apart streams in accordance with the present invention. The jackets printed on the parallel press may be conveyed from the parallel press to an insert feeding station for insertion into the first jackets. This approach to the assembly of large newspapers recognizes that there is a practical limit to the size of a newspaper which may be printed on a conventional rotary printing press.

Another application of the present invention is in the assembly of newspapers of relatively low circulation, for example, 10,000 copies. In such situations a relatively small rotary printing press may be used at high speed to make up portions of the newspaper. The portions are then assembled into a finished product at the inserting machine in accordance with the present invention. This system will enable a small newspaper to operate with fewer press units. The insert feeder heads utilized with this application of the present invention are much less costly than an additional press unit.

Although most rotary printing presses have sufficient power to drive the deflecting mechanism, conveyors and inserting machines which are synchronously driven off the press, a power boost may be provided without losing the advantages of common drive and synchronization.

While not illustrated, it is contemplated that more than two conveyors may be utilized to transport jackets from the printing press. In this regard, the deflector mechanism may be designed to divert jackets to more than two paths. Regardless of the number of paths (utilized with an equal number of conveyors), it is preferable that single successive jackets be directed to each path in succession. For example, if there are four paths, four conveyors and a deflector designed to deliver jackets to each of said paths, it is preferable to have one jacket delivered to each path in succession. In this way the conveyors may be operated at equal speeds and the jackets will be evenly spaced thereon in a non-shingled manner. Designs of deflectors for diverting the stream of jackets to more than two paths are not illustrated herein, but are believed to be within the capabilities of one skilled in the art.

It should be noted that the present invention may be practiced without utilizing a flyer drum. The flyer drum was retained in the preferred embodiment so that when the deflector mechanism is deactivated the printing press may operate through the flyer drum to form a shingled conveyance of jackets in the manner known in the art. However, where such operation is not desired, the flyer drum may be replaced by other conveyor means, for example means operated as auxiliary conveyor 32. Also, it is within the scope of the invention to use multiple flyer drums to transfer jackets to appropriate conveyor means.

As used herein, the term "jacket" is deemed to include any printed matter into which an insert or inserts may be fed. Although not illustrated, the insert feeding station may include means for inserting a plurality of inserts into each jacket.

What is claimed is:

1. A method for feeding jackets of printed matter into an inserting machine which is synchronously driven directly by a rotary printing press, comprising the steps of:

diverting alternate jackets from a single press stream into multiple streams of slower throughput;

directing each of said multiple streams to a respective conveyor;

delivering the jackets on each conveyor to an inserting line of an inserting machine; and prior to entering the inserting line, driving said conveyors at such speed so as to cause said jackets to be spaced apart at such distance so as to be compatible with the operation of the inserter.

2. A method as claimed in claim 1 wherein said inserting machine is a tandem inserting machine comprising at least one insert feeding station positioned along each one of multiple inserting lines and said method further comprises the steps of:

conveying said jackets from two of said conveyors to the tandem inserting machine and depositing said jackets on said machine to form two lines of spaced-apart jackets;

transporting said jackets along the tandem inserting machine to the insert feeding stations; and feeding a selected number of inserts into each of said jackets at said insert feeding stations to form two lines of finished products on said tandem inserting machine.

3. A method as claimed in claim 2 wherein said two lines of finished products are merged to form a single line of compensated stacks of two finished products each.

4. A method as claimed in claim 3 wherein said stacks of two finished products are conveyed to a stacker to provide a compensated bundle.

5. A system useful for transforming the single continuous stream of jackets produced by a printing press into multiple streams so that inserts may be fed into the jackets in said streams to form finished products, comprising:

first and second conveyors;

first means for receiving jackets from the press to establish a first stream of jackets on said first conveyor;

second means for diverting alternate jackets from said press to bypass said first means and thereby establish a second stream of jackets on said second conveyor;

means synchronously controlled by the press for operating said first and second conveyors at substantially equal speeds sufficient to provide spaces between the jackets in said streams.

6. The system of claim 5 further comprising a tandem inserting machine which includes:

means for receiving said first stream of spaced apart jackets; and means for receiving said second stream of spaced apart jackets with the folds of said jackets being aligned parallel to and disposed towards the folds of said jackets in said first stream.

7. A system as claimed in claim 6 including an insert feeder positioned on each side of said tandem inserting machine each feeder servicing one of said two lines of jackets.

8. A system as claimed in claim 7 wherein said first and second means, first and second conveyors, means controlled by the press, tandem inserting machine means and insert feeders are synchronously driven by the press.

9. A system as claimed in claim 7 including, downstream from said insert feeders, means for merging and compensating finished products.

10. A system as claimed in claim 9 including, downstream from said means for merging and compensating, a stacking station comprising at least two on-line bins and means for selectively directing the finished products to either of the bins to form bundles of a predetermined size.

11. A system as claimed in claim 10 including means for transferring the bundles to a conveyor.

12. A system as claimed in claim 5 wherein said second means for diverting alternate jackets comprises at least one deflector blade pivotally mounted for oscillating into and out of the path of jackets in said press stream.

13. A system as claimed in claim 12 wherein said second conveyor comprises a belt conveyor having opposed belts for holding and transporting jackets therebetween.

14. A system as claimed in claim 5 wherein said first means for receiving jackets comprises a flyer drum.

15. A system as claimed in claim 5 wherein said first means for receiving jackets comprises a flyer drum and said system includes means for selectively deactivating said second means for diverting alternate jackets whereby the complete press stream may be selectively conveyed to the flyer drum.

16. A system as claimed in claim 5 including means for receiving said first and second streams comprising a carousel insert feeding machine.

* * * * *